United States Patent [19]

Martinez

[11] Patent Number: 4,807,499

[45] Date of Patent: Feb. 28, 1989

[54] SOCKET DRIVE AND SOCKET WITH STABLE UNIVERSAL COUPLING

[76] Inventor: Daniel M. Martinez, 306 Valley St., Delhi, La. 71232

[21] Appl. No.: 89,831

[22] Filed: Aug. 27, 1987

[51] Int. Cl.[4] ..... B25B 13/00

[52] U.S. Cl. ..... 81/177.75; 81/177.7

[58] Field of Search ..... 81/177.75, 177.7; 403/57, 58, 114, 116

[56] References Cited

U.S. PATENT DOCUMENTS

| | | | |
|---|---|---|---|
| 2,794,357 | 6/1957 | Lykins | 81/177.5 |
| 4,065,941 | 1/1978 | Aoki | 81/177.5 |
| 4,271,731 | 6/1981 | Suligoy et al. | 81/177.7 |

*Primary Examiner*—Frederick R. Schmidt
*Assistant Examiner*—Lawrence Cruz
*Attorney, Agent, or Firm*—John M. Harrison

[57] ABSTRACT

A socket drive and socket having a stable univeral coupling, which is characterized by a drive shaft having a drive member at one end for interfacing with a ratchet wrench and the other end provided with a universal coupling configured to receive a socket, which is capable of adjustment both in alignment with the drive shaft and in 360 degree, angular rotation with respect to the drive shaft. Multiple, stable angular orientation of the socket in a 360 degree path of travel is facilitated by operation of a spring-loaded collar which is seated on the drive shaft by means of a snap ring and sleeve combination, and is biased against the socket.

17 Claims, 1 Drawing Sheet

SOCKET DRIVE AND SOCKET WITH STABLE UNIVERSAL COUPLING

BACKGROUND OF THE INVENTION

FIELD OF THE INVENTION

This invention relates to socket wrenches and more particularly, to a specially designed socket drive and socket having a universal coupling which is designed to selectively engage, remove and tighten bolts and nuts that are located in inaccessible areas in such machinery as combines, machines for picking cotton and other machinery and equipment. The socket drive and socket combination of this invention is characterized by a drive member located at one end of a drive shaft for engaging a conventional ratchet wrench or other drive mechanism and a socket mounted to a universal coupling on the opposite end of the drive shaft. The socket is maintained in selective alignment with the drive shaft in stable, angular relationship with respect to the drive shaft about a 360 degree axis of rotation, by means of a spring-loaded collar which is seated on the drive shaft by a sleeve and snap-ring combination. Both the socket and the collar are bevelled at the respective edges of contact to maintain this selective fixed angular relationship, in order to facilitate insertion of the socket on relatively inaccessible bolt heads and nuts located in heavy equipment such as engines, combines, cotton-picking equipment and like machinery.

One of the problems which exists in the maintenance of complex machinery and other equipment assembled with nuts and bolts is that of inserting a socket on a bolt head or nut located in relatively inaccessible spaces and areas in the machinery. Socket drive systems which are fitted with conventional universal joints for attaching the sockets to the drive shaft are available to help in this regard, but since the conventional universal joint socket attachment is deliberately loose to facilitate slack in the universal joint coupling, it is sometimes difficult to match the socket with a selected bolt or nut for removal or tightening of the bolt or nut in a given location. This problem is intensified under circumstances where many such bolts and nuts must be periodically removed and then replaced, or tightened in the course of repairing and/or maintaining such equipment.

Description of the Prior Art

Various types of socket wrenches provided with universal joints to facilitate loose pivotal and rotatable motion of a socket are known in the art. an early patent which details a wrench provided with a spring-loaded universal mechanism is U.S. Pat. No. 1,102,863, dated July 7, 1914, to F. J. Boajas. The wrench detailed in this patent includes a drive shaft provided with a t-bar at one end and a housing located at the opposite end, with a universal joint and socket pivotally attached to the opposite end of the shaft inside the housing. A spring is positioned in the housing and a clip is shaped in the housing, such that the socket and the universal joint can be selectively retracted inside the housing, in order to use the socket wrench without benefit of the universal joint in a first mode and extend the universal joint from the housing in a second mode. U.S. Pat. No. 3,855,884, dated Dec. 24, 1974, to Warren L. McPeak, discloses a "Locking Universal Joint". This patent details a conventional universal joint which is modified by elongating the output shaft and providing this shaft with a sliding collar. The shaft carries a flange near its end to prevent removal of the collar, two holes are provided in the output shaft and a single diametral hole is also provided in the collar. When the collar is oriented to one of its extreme positions against the body of the universal joint, the collar hole is aligned with one of the shaft holes and a pin is used to hold the collar in that position, thus immobilizing the universal joint. When the collar is positioned to its other extreme position against the flange, the collar hole is aligned with the other shaft hole. The collar, pinned in this position, thus permits the universal joint to move to any angle within its limits. U.S. Pat. No. 4,026,125, dated May 31, 1977, to James T. Patterson, details a "Flexible Drive Adapter". This adapter is designed for installation of the spindle of a portable hand-held drill motor and is arranged to drive a cutting tool such as a taper lock reamer. The adapter permits universal movement between the input shaft connected to the spindle of the portable hand-held drill motor and the cutting tool and includes means for adjustably regulating the freedom of movement, while dampening any shock transmitted from the cutting tool through the adapter. A "Universal Joint" is detailed in U.S. Pat. No. 4,065,941, dated Jan. 3, 1978, to S. Aoki. The universal joint is adapted for use in high-impact wrenches and includes a tubular housing having a first end and a second end. A first ball joint having an input shaft with a ball member is disposed at one end thereof and an attaching head disposed at the other end thereof is coupled to the tubular housing adjacent the first end. A second ball joint having an output shaft with a ball member disposed at one end thereof and a socket head disposed at the other end, is coupled to the tubular housing adjacent the second end. An external spring is disposed about the output shaft and journalled between the socket head and the second end of the housing. The external spring is arranged and configured on the universal joint so as to increase the flexibility of the second ball joint and to cause the second ball joint to return to axial alignment with the tubular housing after each use. An internal spring may also be disposed in the tubular housing journalled between the ball member of the first ball joint and the ball member of the second ball joint, to increase the axial flexibility of the universal joint. U.S. Pat. No. 4,271,731, dated June 9, 1981, to Diane Suligoy, discloses a "Pivot Tip Hand Tool". The pivot tip hand tool detailed in this patent includes an elongated shank, an axial recess or bore therein opening to the work piece end and a work piece shaft positioned in the bore for relative sliding movement between a retracted position and an extended position. Further included is a first lock assembly designed to hold the shaft in the extended position until released and a socket member pivotally mounted on the work piece shaft having a socket for receiving a shank of a tool such as a screwdriver therein, the socket member being pivotable between a first position, in which its socket is axially aligned with the work piece shaft and a second position, in which its socket is at substantially right angles to said shaft. A second lock assembly is also provided to hold the socket member in the first and second positions, respectively, until released. A "Wrench Assembly For Use With Mine Wall Support Bolts" is disclosed in U.S. Pat. No. 4,530,261, dated July 23, 1985, to Robert M. Ventura. Then wrench detailed in this patent includes an elongated shaft shaped to be engaged and driven by a mine bolting machine. The shaft is coupled to a bolt socket by a universal joint and a removable, resilient, impermeable sleeve surrounds the universal joint. The sleeve is formed of a non-metallic material having physical properties which limit the movement of the universal joint and also seal the joint against the infusion of solid and fluid matter. The sleeve is secured in place by a removable clamp.

It is an object of this invention to provide a new and improved socket drive and socket with a stable universal coupling which is characterized by the capability for orienting the socket in stable, but easily adjustable, angular relationship with respect to the shaft in a 360 degree freedom of rotation, to engage bolt heads and nuts located in relatively inaccessible positions.

Another object of the invention is to provide a new and improved socket drive having a universal coupling and attached socket, which device is characterized by an elongated drive shaft having a drive member at one end for interfacing with a ratchet wrench or other drive wrench and a socket at the other end, which socket is mounted on a universal joint and is biased by a spring-loaded collar to facilitate selective operation, both in alignment with the shaft and in stable, adjustable angular relationship with respect to the shaft.

Another object of the invention is to provide a new and improved socket drive and socket with a stable universal coupling, which is fitted with a spring-loaded collar, for loosening and tightening bolts and nuts located in relatively inaccessible locations in cotton-picking equipment and other machinery.

Still another object of this invention is to provide a socket drive having a universal coupling and a shallow or deep socket located at one end, wherein the socket is selectively biased either in alignment with the drive shaft or in stable, but easily adjusted angular orientation with respect to the drive shaft, by means of a spring-loaded collar in order to reach inaccessible bolts and nuts in various equipment and machinery.

A still further object of the invention is to provide a new and improved socket drive and socket having a stable universal coupling at one end and a drive member suitable for interfacing with a ratchet wrench or other drive means at the opposite end, which universal coupling receives the socket in universal, but stable operation, to facilitate tilting of the socket with respect to the drive shaft at a selected angle with a 360 degree freedom of rotation by means of a spring-loaded collar, to reach relatively inaccessible bolts and nuts located in combines, cotton picking equipment and other machinery.

SUMMARY OF THE INVENTION

These and other objects of the invention are provided in a new and improved socket drive characterized by a shaft having a drive member for interfacing with a ratchet wrench or other drive mechanism at one end and a universal coupling at the opposite end, with a socket attached to the universal coupling in loose, universal freedom of movement and a spring-loaded collar located on the shaft and provided in engagement with the socket, in order to remove the slack in the universal coupling and facilitate selective use of the socket, both in alignment with the shaft and tilting of the socket with respect to the shaft in a stable, 360 degree range of motion, to effect engagement of relatively inaccessible bolts and nuts with the socket and loosening and tightening the bolts and nuts, as desired.

BRIEF DESCRIPTION OF THE DRAWING

The invention will be better understood by reference to the accompanying drawing, wherein.

DESCRIPTION OF THE PREFERRED EMBODIMENTS

Figure 1:
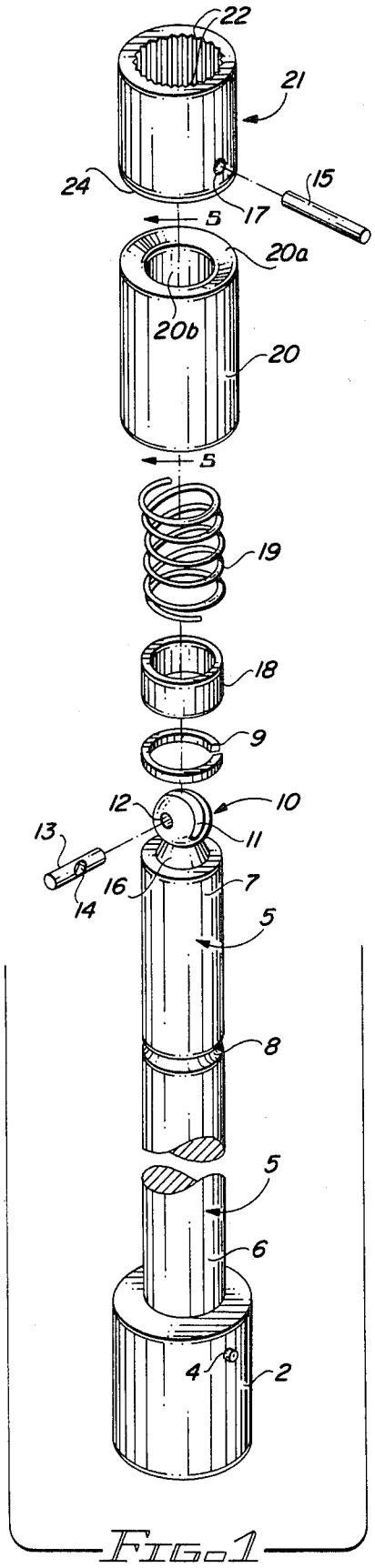
FIG. 1 is an exploded view of a preferred embodiment of the socket drive and socket with stable universal coupling of this invention.
Figure 3:
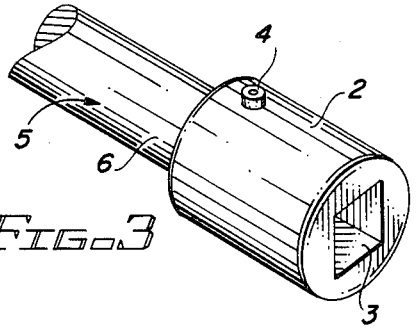
FIG. 3 is a perspective view of the drive member end of the socket drive and socket with stable universal coupling of this invention.

Referring initially to FIGS. 1 and 3 of the drawing, the socket drive and socket with stable universal coupling (hereinafter referred to as "socket drive") of this invention is generally identified by reference numeral 1 and includes an elongated drive shaft 5, having a cylindrical drive member 2 mounted on the drive member end 6 thereof, by means of a drive pin 4. The drive member 2 is further illustrated in FIG. 3 and includes a drive member seat 3 fitted therein for receiving a conventional socket wrench drive (not illustrated) and operating the socket drive 1, as hereinafter further described. In a preferred embodiment of the invention, the drive pin 4 is characterized by a roll pin which is easily driven from registering apertures (not illustrated) provided in the drive member seat 2 and the drive member end 6 of the drive shaft 5, to remove the drive member 2 from the drive shaft 5, as desired. As further illustrated in FIG. 1, the opposite socket end 7 of the drive shaft 5 is provided with a rounded socket head 10, which extends from a shaft neck 16, shaped in the socket end 7. The socket head 10 is further provided with a socket pin slot 11 and a companion socket head seat 12, which extends through the socket head 10 in transverse relationship with respect to the socket pin slot 11, as illustrated. A socket head pin 13 is designed to fit tightly in the socket head seat 12 and extends through the socket pin slot 11. The socket head pin 13 is further provided with a socket head pin opening 14, which extends transverse to the longitudinal axis of the socket head pin 13, as illustrated. A snap ring groove 8 encircles the drive shaft 5 in spaced relationship with respect to the shaft neck 16 and is designed to receive a snap ring 9, in order to locate and seat a collar sleeve 18 in slidable relationship on the drive shaft 5 and prevent the collar sleeve 18 from slidably traversing the drive shaft 5 below the snap ring 9 toward the drive member 2. A collar spring 19 is also fitted on the drive shaft 5 in slidable relationship and is designed to rest on the opposite edge of the collar sleeve 18, as illustrated in FIG. 1.

Figure 5:
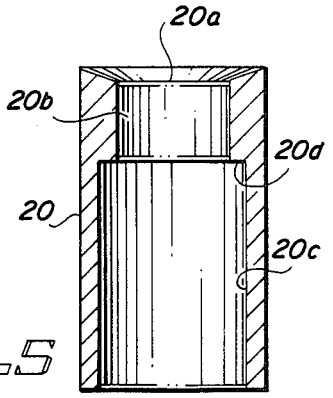
FIG. 5 is a sectional view, taken along line 5—5 of a preferred collar used in the socket drive and socket with stable universal coupling illustrated in FIG. 1.

Referring now to FIGS. 1 and 5 of the drawing, a generally cylindrically-shaped collar 20 is provided with an internal collar bevel **20*a* at the top end thereof and with an internal cylindrical collar neck 20*b*, which is smaller in diameter than the companion collar bore 20*c*, as illustrated in FIG. 5. In a preferred embodiment of the invention, the diameter of the collar neck 20***b* is slightly larger than the diameter of the drive shaft 5, in order to facilitate slidable movement of the collar 20 along the drive shaft 5. Furthermore, the diameter of the collar bore 20*c* is slightly larger than the outside diameter of the collar sleeve 18, to allow the collar sleeve 18 to slidably fit inside the collar bore 20*c*, as illustrated. The collar spring 19 also slidably fits on the drive shaft 5 inside the collar bore 20*c* of the collar 20, between the collar sleeve 18 and the collar shoulder 20*d*, which is defined by the collar neck 20*b* and the collar bore 20*c*. Accordingly, referring again to FIGS. 1 and 5 of the drawing, when the collar 20 is slidably inserted on the socket end 7 of the drive shaft 5, the top coil of the collar spring 19 is seated against the collar shoulder 20*d*, illustrated in FIG. 5, and the bottom coil of the collar spring 19 is seated against the collar sleeve 18, which is in turn, seated against the snap ring 9, located in the snap ring groove 8.

Figure 4:
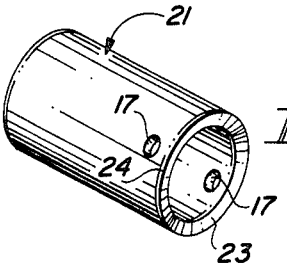
FIG. 4 is a perspective view of a preferred socket for use in cooperation with the universal coupling illustrated in FIG. 1.

As further illustrated in FIGS. 1 and 4, a generally cylindrically-shaped socket 21 is provided at one end with multiple socket points 22 and is fitted with a pair of socket pin seats 17 near the opposite end, which socket pin seats 17 extend in oppositely-disposed relationship through the wall of the socket 21. A socket pin 15 is adapted to seat tightly in the facing socket pin seats 17 and extends through the socket head pin opening 14, located in the socket head pin 13, when the socket head pin 13 is, in turn, inserted in the socket head seat 12 of the socket head 10, as illustrated. This mounting of the socket 21 on the socket head 10 and engagement of the socket 21 with the collar 20 under the influence of the collar spring 19, facilitates universal angular rotation of the socket 21 in a 360 degree path without the looseness and slack of conventional universal socket motion, as hereinafter further described. This motion is enhanced by the inside socket bevel 23, illustrated in FIG. 4, which allows greater freedom of rotation of the socket 21 on the socket head 10.

Figure 2:
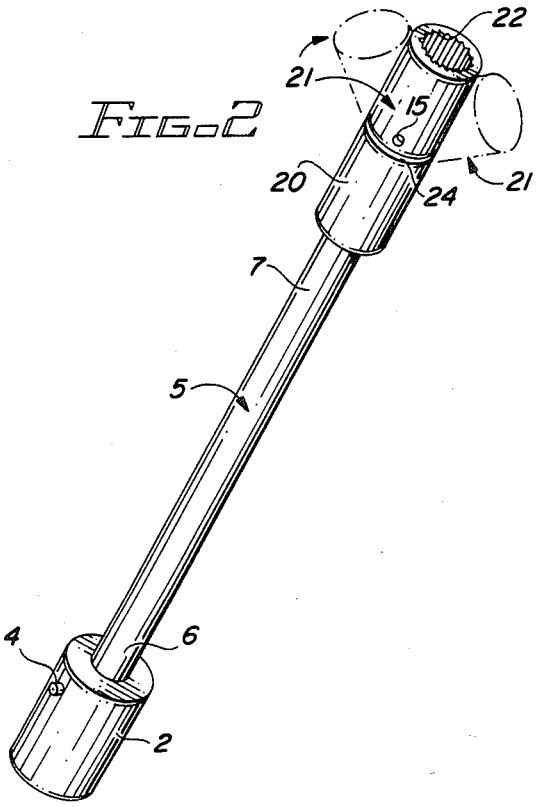
FIG. 2 is a perspective view of the socket drive and socket with stable universal coupling in assembled configuration, illustrating optional stable, angular rotational movement of the socket.

Referring now to FIGS. 1, 2, 4 and 5 of the drawings and particularly to FIG. 2, the spring-loading of the collar 20 against the socket 21, coupled with the internal collar bevel 20*a* and the outside socket bevel 24, provided in the end of the socket 21 which engages the collar 20, facilitates stable, angular adjustment of the socket 21 with respect to the drive shaft 5 and the collar 20 in a 360 degree range of motion, as illustrated in phantom in FIGURE 2. Accordingly, due to the bias of the collar 20 against the socket 21, the socket 21 is stable and not loosely secured to the socket head 10, as is the case in conventional socket drive mechanisms, and it is selectively held in alignment with the drive shaft 5 and in alternative angular relationship, by operation of the collar spring 19. However, once the socket points 22 and the socket 21 have engaged a bolt head or nut in functional orientation (not illustrated), this angular relationship, which is determined by the mating collar bevel 20*a* and outside socket bevel 24, can be adjusted by manipulation of the drive shaft 5, to fit the bolt head or nut in an optimum manner and either loosen or tighten the bolt or nut, as desired. Since the socket 21 is not loosely attached to the socket head 10 in conventional fashion, but is held in place at the selected angle by operation of the collar 20 and collar spring 19, it is much more easily fitted to a bolt head or nut in a relatively inaccessible location, to secure the socket points 22 on the bolt head or nut and tighten or loosen the bolt head or nut, as desired.

It will be appreciated by those skilled in the art that the socket 21 can be characterized by a conventional socket having a desired number of socket points 22 which is characteristically either 12 points or 6 points. However, in a preferred embodiment of the invention, a "deep" or "shallow" socket 21 having six socket points 22 is utilized in the socket drive of this invention. It will be further appreciated by those skilled in the art that the socket drive 1 can be used in cooperation with substantially any ratchet wrench or other drive mechanism having a conventional drive which fits the drive member seat 3 in the drive member 2, in order to facilitate operation of the socket drive 1. Furthermore, the size of the drive member seat 3 can be varied according to the knownledge of those skilled in the art, in order to fit various drives commonly used in conventional socket wrenches. Such drives are commonly either $\frac{3}{8}$ inch or $\frac{1}{2}$ inch in size, although drive members seats 3 of any other size, including various metric sizes, in non-exclusive particular, can be used in the drive member 2, as desired. Furthermore, it will be also appreciated that the length and diameter, as well as the cross-sectional configuration of the drive shaft 5 can be varied, depending upon the particular application desired.

It will be further appreciated by those skilled in the art that the socket drive and socket with stable universal coupling of this invention offers a versatile and useful tool for loosening and tightening bolts and nuts in relatively inaccessible areas such as in combines, cotton pickers and other equipment and machinery. Referring again to the drawings, since the drive shaft 5 can be of any selected length and the socket 21 of any selected depth to accommodate substantially any nut or bolt used in the machine or equipment to be maintained, the socket 21 can be adjusted under the influence of the collar 20 and collar spring 19 to remain in angular relationship with respect to the collar 20 and the drive shaft 5, in order to facilitate initial placement of the socket points 22 directly over and in engagement with the nut or bolt in question. This angular relationship can then be adjusted as needed by manipulating the drive shaft 5, in order to tighten or loosen the nut or bolt by means of a conventional ratchet wrench or other drive mechanism which interfaces with the drive member 2 on the opposite end of the drive shaft 5. Alternatively, the collar 20 and collar spring 19 serve to stabilize the socket 21 in alignment with the drive shaft 5 when the socket drive 1 is used in conventional fashion without the necessity of incorporating the universal function to angle the socket 21 to loosen or tighten a bolt or nut.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A socket drive and socket with stable universal coupling comprising a shaft, drive means carried by one end of said shaft for receiving a drive wrench; universal coupling means carried by the opposite end of said shaft and a socket carried by said universal coupling means, wherein said socket is adapted for free, pivotal and angular orientation with respect to said shaft into and from alignment with said shaft; a groove provided in said shaft in spaced relationship with respect to said universal coupling means and ring means seated in said groove; collar means slidably mounted on said shaft adjacent to said socket; bias means mounted on said shaft in contact with said collar means and said ring means and sleeve means slidably carried by said shaft, said sleeve means seated on said ring means for securing said bias means on said shaft, said bias means adapted for urging said collar means against said socket and selectively maintaining said socket in substantially stable alignment with said shaft in the first preferred position and in stable, pivotal and angular orientation with respect to said shaft, in a second preferred position, respectively.

2. The socket drive of claim 1 wherein said bias means further comprises a coil spring.

3. The socket drive of claim 1 wherein said bias means further comprises a coil spring, said sleeve means further comprises a generally cylindrically-shaped sleeve and said ring means further comprises a snap ring.

4. The socket drive of claim 1 wherein said collar means further comprises a generally cylindrically-shaped collar provided with an internal collar neck having a diameter larger than the diameter of said shaft and further comprising a collar shoulder defined by said collar neck for receiving said bias means.

5. The socket drive of claim 4 wherein said bias means is a coil spring.

6. The socket drive of claim 4 wherein said bias means further comprises a coil spring fitted inside said collar and located between said collar shoulder and said sleeve means.

7. The socket drive of claim 1 wherein said drive means further comprises a generally cylindrically-shaped drive member and a seat provided in said drive member, said seat adapted for removably receiving the drive of the drive wrench and operating said socket drive.

8. The socket drive of claim 1 wherein:

(a) said collar means further comprises a generally cylindrically-shaped collar provided with an internal collar neck having a diameter larger than the diameter of said shaft and further comprising a collar shoulder defined by said collar neck for receiving said bias means; and (b) said drive means further comprises a generally cylindrically-shaped drive member and a seat provided in said drive member, said seat adapted for removably receiving the drive of the drive wrench and operating said socket drive.

9. The socket drive of claim 4 wherein said ring means further comprises a snap ring and said bias means further comprises a coil spring fitted inside said collar and located between said collar shoulder and said sleeve means.

10. The socket drive of claim 9 wherein said universal coupling means further comprises a rounded socket head shaped in said opposite end of said shaft; a slot provided in said socket head, said slot oriented substantially in a plane which bisects the longitudinal axis of said shaft; a socket head seat provided in said socket head transverse to said slot; a socket head pin projecting through said socket head seat and extending through said slot and a socket head pin opening provided in said socket head pin in transverse relationship to the longitudinal axis of said socket head pin; a pair of socket pin seats provided in the wall of said socket in oppositely-disposed relationship across a diameter of said socket and a socket pin projecting through said socket pin seats and said socket head pin opening in said socket head pin, for securing said socket to said socket head in 360 degree rotatable and pivotal relationship.

11. A socket drive and socket combination having a stable universal coupling, comprising an elongated drive shaft; a drive member attached to one end of said drive shaft, said drive member adapted to receive the drive of a ratchet wrench in driving relationship; universal coupling means provided at the opposite end of said drive shaft and a socket carried by said universal coupling means in universal, pivoting and rotating relationship; a cylindrical collar slidably carried by said drive shaft adjacent said socket; an outside socket bevel provided on said socket and an internal collar bevel provided in said collar, whereby said outside socket bevel contacts said internal collar bevel and stabilizes said socket in said angular orientation with respect to said collar when said socket drive and socket combination is manipulated in said first working position; and bias means carried by said drive shaft and engaging said collar for urging said collar against said socket and maintaining said socket in adjustable, stable, angular orientation with respect to said collar in a first working position and maintaining said socket in substantial alignment with said collar in a second working position.

12. The socket drive and socket combination of claim 11 further comprising a groove provided in said shaft in spaced relationship with respect to said universal coupling means and ring means seated in said groove for locating said bias means on said shaft.

13. The socket drive and socket combination of claim 12 further comprising sleeve means slidably carried by said shaft, said sleeve means seated on said ring means for securing said bias means on said shaft.

14. The socket drive and socket combination of claim 13 wherein said bias means further comprises a coil spring, said sleeve means further comprises a generally cylindrically-shaped sleeve and said ring means further comprises a snap ring.

15. The socket drive and socket combination of claim 14 wherein said collar is further characterized by an internal collar neck having a diameter larger than the diameter of said shaft and a collar shoulder defined by said collar neck for receiving said coil spring.

16. The socket drive and socket combination of claim 15 wherein said universal coupling means further comprises a rounded socket head shaped in said opposite end of said shaft; a slot provided in said socket head, said slot oriented substantially in a plane which bisects the longitudinal axis of said shaft; a socket head seat provided in said socket head transverse to said slot; a socket head pin projecting through said socket head seat and extending through said slot and a socket head pin opening provided in said socket head pin in transverse relationship to the longitudinal axis of said socket head pin; a pair of socket pin seats provided in the wall of said socket in oppositelydisposed relationship across a diameter of said socket and a socket pin projecting through said socket pin seats and said socket head pin opening in said socket head pin, for securing said socket to said socket head in 360 degree rotatable and pivotal relationship.

17. A socket drive and socket with stable universal coupling comprising an elongated shaft of selected length; a drive member attached to one end of said drive shaft, said drive member adapted to receive the drive of a ratchet wrench in driving relationship; a universal coupling carried by the opposite end of said drive shaft from said drive member and a socket attached to said universal coupling in freely universal pivoting and rotating relationship; a cylindrical collar slidably carried by said drive shaft adjacent said collar, said cylindrical collar provided with an internal collar neck and a collar shoulder; a coil spring slidably carried by said drive shaft and disposed inside said collar in engagement with said collar shoulder; a groove provided in said shaft in spaced relationship with respect to said universal coupling and a snap ring secured in said groove for limiting the movement of said coil spring on said drive shaft; and a cylindrical sleeve slidably carried by said drive shaft and positioned between said snap ring and said coil spring for compressing said coil spring, whereby said coil spring urges said collar against said socket and maintains said socket in adjustable, stable, angular orientation with respect to said collar in a first working position and maintains said socket in substantial alignment with said collar in a second working position.

* * * * *